US012071822B2

(12) United States Patent
Bennett et al.

(10) Patent No.: US 12,071,822 B2
(45) Date of Patent: Aug. 27, 2024

(54) GENERATING PRESSURE WAVES IN A FLOWLINE OR A WELLBORE

(71) Applicant: Halliburton Energy Services, Inc., Houston, TX (US)

(72) Inventors: David Bennett, Houston, TX (US); Oluwatosin Ogundare, Houston, TX (US); Chalice Young, Houston, TX (US); Terry Don Bickley, Tyler, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/819,273

(22) Filed: Aug. 11, 2022

(65) Prior Publication Data

US 2024/0052714 A1 Feb. 15, 2024

(51) Int. Cl.
*E21B 21/08* (2006.01)
*E21B 21/10* (2006.01)

(52) U.S. Cl.
CPC ..... *E21B 21/08* (2013.01); *E21B 21/10* (2013.01)

(58) Field of Classification Search
CPC ..... E21B 21/08; E21B 21/10
See application file for complete search history.

(56) References Cited

U.S. PATENT DOCUMENTS 8,346,492 B2 1/2013 Yang et al.
2020/0033899 A1* 1/2020 Van Haaren ..... E03B 11/08
2020/0182831 A1 6/2020 Jha et al.
2021/0032979 A1 2/2021 Granville et al.
2021/0040841 A1* 2/2021 Dusterhoft ..... G01V 8/16
2021/0190665 A1 6/2021 Bennet et al.

FOREIGN PATENT DOCUMENTS

CN 109113727 B 2/2022
EP 0697587 B1 6/2002
WO 0225062 A1 3/2002

OTHER PUBLICATIONS

Ghidaoui et al., "A Review of Water Hammer Theory and Practice", Applied Mechanics Reviews, vol. 48, pp. 49-76, Jan. 2005.
Provenzano et al., "The Closing Function in the Waterhammer Modeling", Latin American Applied Research, vol. 41, 2011, 2011, pp. 43-47.
Subani et al., "Analysis of Water Hammer with Different Closing Valve laws on Transient Flow of Hydrogen-natural Gas Mixture", Department of Mathematical Sciences, Faculty of Science, University Teknologi Malaysia (UTM), Johor, Malaysia, 2015, 13 pages.
International Patent Application No. PCT/US2022/074871, International Search Report and Written Opinion mailed May 4, 2023, 12 pages.

* cited by examiner

*Primary Examiner* — Dany E Akakpo
(74) *Attorney, Agent, or Firm* — Kilpatrick Townsend & Stockton LLP

(57) ABSTRACT

A system can be used for generating a pressure signal in a flow path defined by a tubular. The system can include a pressure source, a valve, and a controller. The controller can output a command to control the pressure source for outputting a fluid hammer, according to the command, through the valve and into a flow path defined by a wellbore tubular. The system can be positioned external to the flow path. The system can determine, based on the reflection signal, a presence of a deposition, a blockage, or a leak within the flowline while the flowline is in operation.

14 Claims, 5 Drawing Sheets

GENERATING PRESSURE WAVES IN A FLOWLINE OR A WELLBORE

TECHNICAL FIELD

The present disclosure relates generally to wellbore operations and, more particularly (although not necessarily exclusively), to generating pressure waves in a flowline or in a wellbore.

BACKGROUND

Hydrocarbon fluids are produced by wellbores formed in subterranean formations or sub-oceanic formations. The wellbore can have a flowline within the wellbore and may be used to carry fluids, such as drilling fluids and mud for drilling operations, or carry fluids for production operations. The fluids that flow through the flowline may cause depositions, blockages, or leaks along the flowline that may interfere with and reduce productivity of the wellbore or flowline. A wellbore can range in length from a few hundred meters to several kilometers. For example, a completion operation can include a complex wellbore tubular design spanning several kilometers with multiple turns and connections. As complexity within the wellbore design increases, evaluating the condition of the wellbore can become more complex.

DETAILED DESCRIPTION

Figure 1:
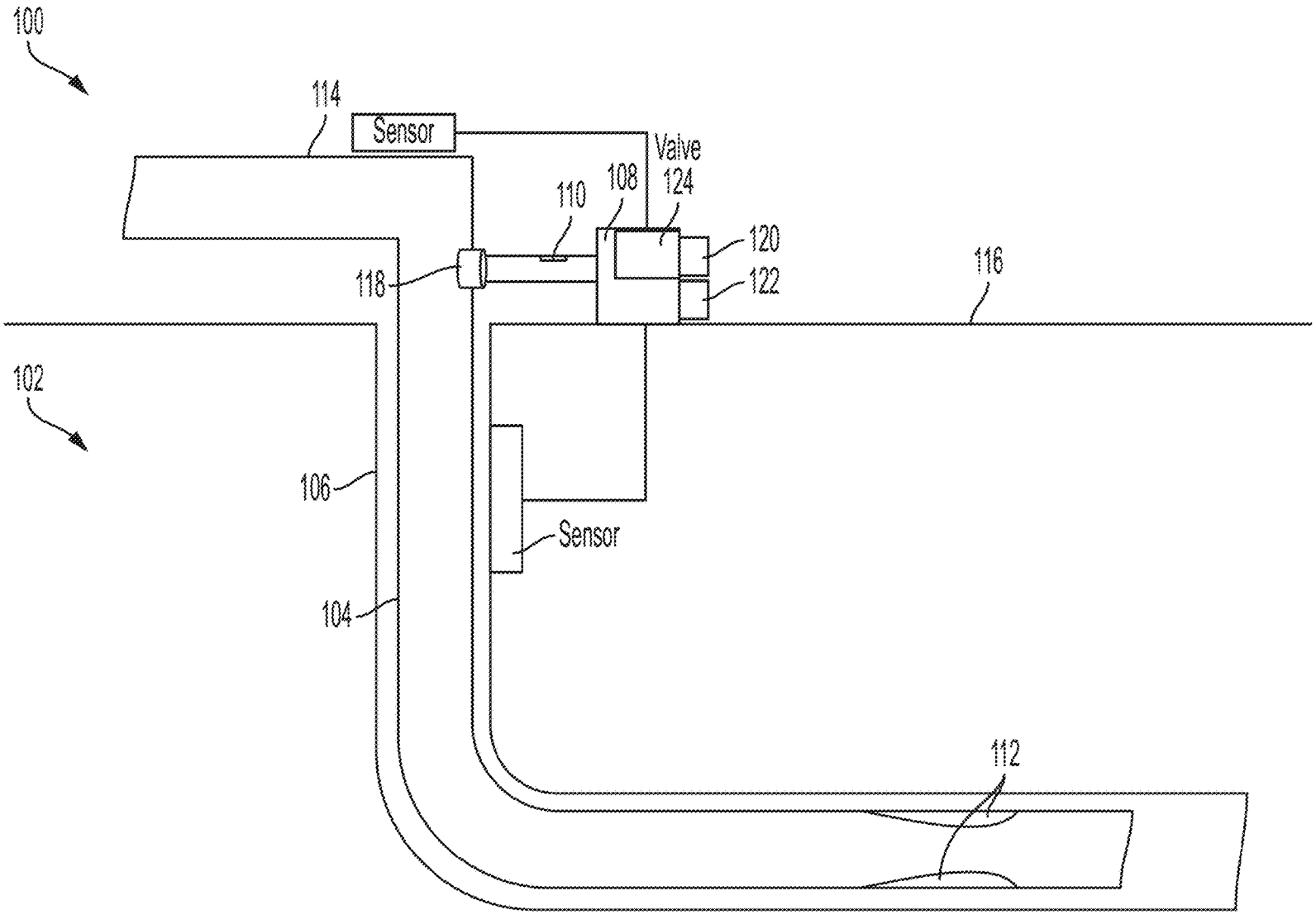
FIG. 1 is a schematic of a wellbore and apparatus for generating a pressure wave within a wellbore according to one example of the present disclosure.

Certain examples of the present disclosure involve an apparatus for generating a pressure signal into a flow path defined by a wellbore that is positioned external to the flow path. The flow path can be defined by a flow line, a tubular on a surface, a tubular on a seabed, or a tubular in a wellbore. A tubular may include a pipeline tubular, a wellbore tubular, or other types of tubulars. The flow path defined by the wellbore may align with a first axis that is a central axis of the wellbore tubular and the apparatus may be positioned along a second axis that is different than the first axis. For example, the apparatus may be positioned external to the annulus of a wellbore. In some examples, the apparatus may be positioned at a surface and in fluid communication with a flowline or a wellbore disposed within a subterranean formation. The apparatus may be pressurized to a pressure that is higher than the pressure in a wellbore via a pressure source within the apparatus. The apparatus can then release the pressure into the flow path defined by the wellbore and generate a fluid hammer. A water hammer (or fluid hammer) is a pressure surge (or signal) that can be caused by the closing or opening of a valve to generate a pressure difference in a moving liquid. The pressure surge (or signal) generated by the apparatus can be proportional to the overall pressure that was released by the apparatus. For example, the apparatus can be pressurized using a gas. The release of the gas from the apparatus into the flowline can generate a pressure signal that can traverse the flowline or wellbore. As the pressure signal traverses the wellbore or flowline, any variation in pipeline diameter, such as a blockage, a deposition, can increase the pressure signal. The signal can be reflected off the blockage or deposition and traverse the flowline or wellbore back to the apparatus. The pressure signal that may be recorded by the data logger, for example by a leak, may be a decrease in the reflected pressure signal. The apparatus can record, via a data logger, pressure variations that occur. The pressure variations recorded can be further interpreted to determine an anomaly within the flowline or wellbore.

In some examples, determining the presence of an anomaly of the flowline or wellbore can be determined based on the Joukowsky water hammer equation (Eqn. 1) and the Darcy-Weisbach equation (Eqn. 2), which are expressed as:

$$\Delta p_j = \rho * AV * \mu \tag{1}$$

$$\Delta p_{dw} = \frac{\lambda}{2} * \frac{\Delta L}{d} * \rho * AV^2 \tag{2}$$

where $\Delta p_j$ is the Joukowsky water hammer magnitude, $\Delta p_{dw}$ is the Darcy-Weisbach pressure loss, $\rho$ is the fluid density, AV is the acoustic velocity, $\mu$ is the viscosity, $\lambda$ is the friction factor, $\Delta L$ is the segment length, and d is the inner diameter. The equations alone may be used for in-line valve closures for generating a pressure signal within a flowline or wellbore.

In some examples, the apparatus can include or be based on a modified Joukowsky water hammer equation (Eqn. 3) which can be expressed as:

$$\Delta p_j = Q * (\rho * B)^{\frac{1}{2}} / A \tag{3}$$

where $\Delta p_j$ is the Joukowsky water hammer magnitude, Q is the volumetric flow, $\rho$ is the fluid density, B is the modulus of compressibility, and A is the cross-sectional area of the pipe. The pressure signal can then be calculated using the associated valve controlling material ingress to the target flowline or wellbore such that a release from the apparatus can generate a pressure signal for use in a targeted flowline or wellbore (e.g., a pressure signal having a shape and being associated with a closing speed). The managed release can be calculated using a standard equation (Eqn. 4) for water hammer pressure measurements which can be expressed as:

$$P_j = \frac{.070QL}{t} + P_i \tag{4}$$

where $P_j$ is the target fluid hammer effect, $P_i$ is the inlet pressure, t is the valve closing time, Q is the volumetric flow, and L is the pipe length.

To achieve the pressure variation that can detect blockages, depositions, or leaks, a simulation can be used to validate the target pressure. The simulation can include collecting data on the target flowline or wellbore, such as the fluid or gas properties, standard operation flow rates, flowline or wellbore diameter at connection point, and the attachment port size. The simulation can be used to identify the characteristics of the controlled fluid hammer to generate a pressure that can be used to detect the blockage, deposition, or leak within the flowline or wellbore. Subsequent to performing the simulation, the apparatus can be in fluid communication with a flowline or wellbore and can be pressurized, based on the simulation, to a target pressure for providing the controlled fluid hammer within the flowline or wellbore. For example, the controlled fluid hammer may include a determined frequency and a determined amplitude, based on the simulation, to generate a pressure signal with a similar amplitude and frequency for detecting a blockage, a deposition, or a leak within the flowline or wellbore.

The apparatus can be in fluid communication with operating flowlines and wellbores while product flow is continued. Techniques that use an in-line valve may require a stop to current operations or flow of fluid through the line to generate a pressure wave for detecting an anomaly. The closure of an in-line valve may then lead to a decrease in productivity and an increase in operating cost. Additionally, conventional methods may introduce error in detecting a deposition, a blockage, or a leak in a flowline or wellbore. For example, an in-line valve closure may generate a pressure signal reflection when the flowline has a turn or T-junction that can be the same pressure signal reflection when the flowline has a blockage, deposition, or leak. The apparatus positioned external to the main flow path can be used to detect a blockage, a leak, or a deposition and physical characteristics of the flowline or wellbore.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a wellbore and apparatus 108 for generating a pressure wave within a wellbore according to one example of the present disclosure. The wellbore 106 can be disposed in a subterranean formation 102 or other suitable type of formation. A tubular 104 or other suitable component of the wellbore 106, can be disposed or otherwise positioned in the wellbore 106 for extracting fluid, such as multi-phase fluid, from the subterranean formation 102 via the wellbore 106. The tubular 104 can be coupled to a surface flowline 114 at the surface 116 of the wellbore 106. Depositions 112 may form along the flow path within the tubular 104 that can restrict the flow of hydrocarbons through tubular 104 and into the surface flowline 114. The surface flowline 114, for example, may be a pipeline, a production tubing, a drill pipe, pup joints, drill collars, or other embodiments of hydrocarbon pipes. In some examples, flowline can be positioned along the sea floor for transporting hydrocarbon fluids from sub-oceanic formations or wellbore disposed in the sub-oceanic formation. The apparatus 108 can be positioned on the surface 116 and can be in fluid communication with the tubular 104 that is connected to the surface flowline 114. For example, the apparatus 108 can be coupled to an attachment port 118 allowing the apparatus 108 to be in fluid connection with the tubular 104. The apparatus 108 can include a sensor 110 that can be positioned in-line with the apparatus 108. The wellbore 106 can include any additional or other suitable components for extracting fluids from the subterranean formation 102.

The apparatus 108 can be coupled to an attachment port 118 positioned along the tubular 104 of a wellbore 106. For example, the attachment port 118 can be located along the surface flowline 114, to allow for opening of the flowline during operations. The apparatus 108 can be positioned external to the main flow path of the tubular 104. The tubular 104 can include areas of depositions 112 that can restrict the flow of hydrocarbon fluids through the tubular 104. In some examples, the depositions 112 can be blockages and leaks that can impact the flow. The apparatus 108, for example, can be used to generate a fluid hammer within the tubular 104. The fluid hammer can, in turn, generate a pressure signal in the tubular 104. An acoustic velocity or speed of the pressure signal generated by the apparatus 108 may be influenced by the physical state of the fluid and the density of the fluid in the tubular 104. The frequency of the pressure signal can affect a rate of attenuation, which can impact whether the reflection of the pressure signal can provide desired information (e.g., whether the reflection signal will reach the sensor 110). The pressure signal can travel along the surface flowline 114 or the tubular 104 within the wellbore 106. The signal can be reflected within the tubular 104 upon interacting with a deposition 112 located along the inner wall of the tubular 104. The deposition 112 can also be a leak or a blockage within the tubular of the wellbore. In some examples, the signal generated may be used to distinguish between a ninety degree turn such as the junction of the tubular 104 to the surface flowline 114 and the deposition 112.

The apparatus 108 can be used to generate the fluid hammer within the surface flowline 114 or tubular 104 and a sensor 110 can be positioned in-line with the apparatus 108 to sense data indicating one or more properties of a reflection signal corresponding to a pressure signal generated from the fluid hammer in the flow path signal output from the apparatus 108 and the reflection signal generated within the tubular 104 or surface flowline 114. The apparatus 108 can for example, have additional sensors positioned along the surface flowline 114 or wellbore 106. The additional sensors can be used to sense the reflection signal down alternate paths of the surface flowline 114. For example, a flowline could have ninety degree turns, or multiple T-junction points. The turns and alternate paths can have a sensor 110 positioned along the flow path to sense the pressure signal generated by the fluid hammer from the apparatus 108.

The apparatus 108 can be communicatively coupled to a computing device 120. The computing device 120 can be used for opening a valve 124 in the apparatus 108. The opening of the valve 124 can alter properties of the pressure signal generated. For example, an instantaneous opening speed of the valve 124 can generate a higher amplitude and shorter frequency signal within the tubular 104. Alternatively, a non-instantaneous open can generate a pressure signal with a lower amplitude and lower frequency. In some examples, the valve 124 can be closed at varied speeds to determine physical characteristics of the flowline or wellbore 106 such a bend or T-junction. The computing device 120 can receive the pressure signal or converted signal from the sensor 110 and can determine the characteristics of the flowline or tubular 104 within the wellbore 106. For example, the computing device 120 can receive the pressure signal or converted pressure signals and can determine a deposition, a blockage, a leak, or any suitable combination thereof within the fluid flow path. The apparatus 108 can include a data logger 122 communicatively coupled to the apparatus 108. The data logger 122 can be used to collect the pressure signals generated within the fluid flow path. For example, the data logger 122 can receive data at a high sample rate such as sample rates of 4000 samples a second.

Figure 2:
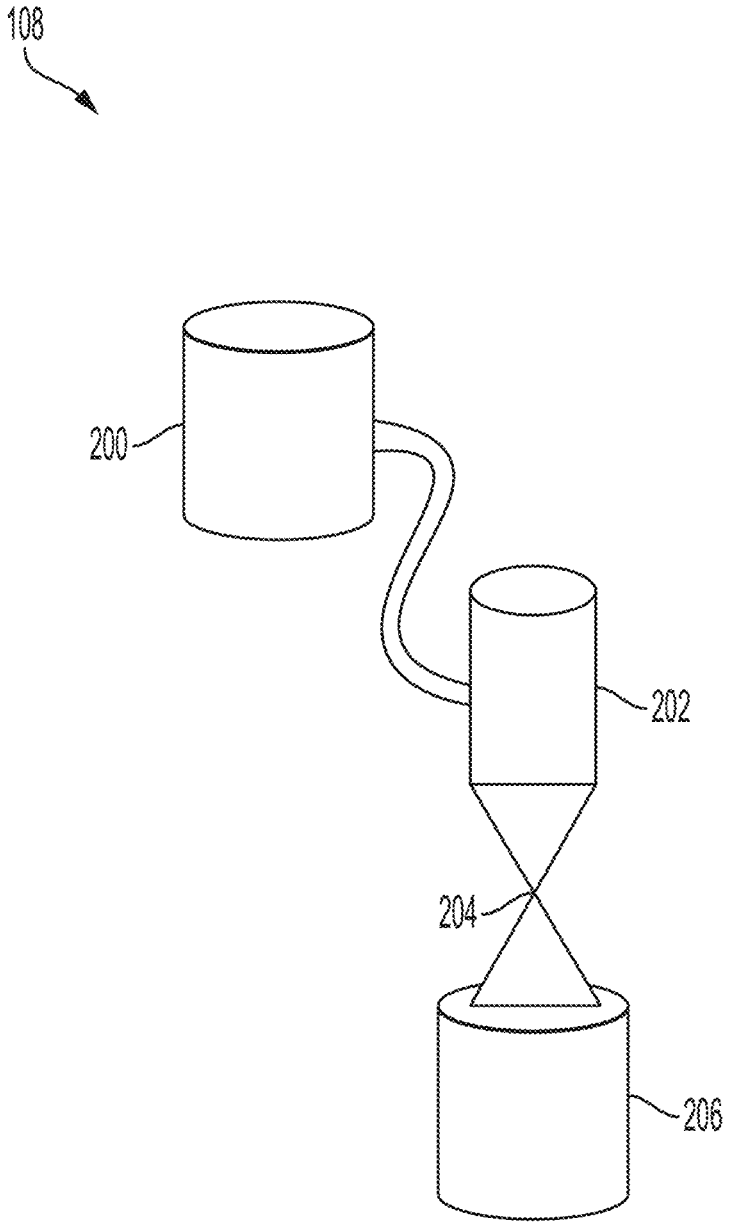
FIG. 2 is a schematic of the apparatus of FIG. 1 for generating a pressure wave into a flow path defined by a wellbore tubular according to one example of the present disclosure.

FIG. 2. is a schematic of the apparatus 108 of FIG. 1 for generating a pressure wave into a flow path defined by a wellbore tubular according to one example of the present disclosure The apparatus 108 can include components, such as the components described below, that can be formed or otherwise coupled to an attachment port 118 along the surface flowline 114. For example, the apparatus 108 can include a pressure source 204 in fluid connection with a charging cartridge 202. In some examples the pressure source 200 can be a gas canister. The pressure source 200 can be used to re-pressurize the charging cartridge 202. The pressure source can be any secondary pressure source such as pressure source on an offshore rig. The charging cartridge 202 can be coupled to a controller 204 The pressure source can be used to pressurize the charging cartridge to a pressure level that is higher than the pressure in the tubular 104. The controller can be coupled to an attachment apparatus 206. The attachment apparatus can be used to couple the apparatus 108 to the attachment port 118. In some examples, the apparatus 108 can include a computing device 120 that can be communicatively coupled to the controller 204, which can control a valve 124. In some examples, the valve 124 may be positioned internal to the controller 204 such that the computing device 120 may be used to send a command to the controller 204 that can control the opening and closing of the valve 124. In some examples, the valve 124 may be positioned between the pressure source 200 and controller 204.

The valve 124 can be controlled by the computing device 120 to generate a pressure signal having a shape and being associated with an opening speed. For example, the pressure signal generated by the opening of the valve 124 can have a convex or concave shape associated with the valve 124 opening. The valve 124 opening speed over time can be used to determine physical characteristics of the pipes including bends and junctions. For example, a first pressure signal can be generated at an instantaneous opening of the valve 124. The pressure signal from the instantaneous opening can be detected by the sensor and recorded in the data logger. Following, the pressure source 200 can re-pressurize the charging cartridge 202 to generate a second pressure signal. The valve 124 opening for the second pressure signal can be opened over a time segment, for example over 2 seconds. The second pressure signal can be detected by the sensor 110 and can be recorded in the data logger 122. The data stored in the data logger 122 can be used by the computing device 120 to determine the physical characteristic such as a bend from a deposition 112 within the tubular 104 of a wellbore.

The controller 204 can include additional components including monitors for inflow pressure and outflow pressure that can be collected from the sensor 110. The apparatus 108 can include a material container that can be couple to the controller for injecting material into the flowline or wellbore. The material container can be a repository that can store material that is different than the material within the wellbore. In some examples, the material container may be coupled to the pressure source 200 for injecting the material within the material container into the flowline or wellbore. The material within the container can include treatment solutions for treating the depositions, blockages, or leaks within the tubular 104 of the wellbore 106.

Figure 3:
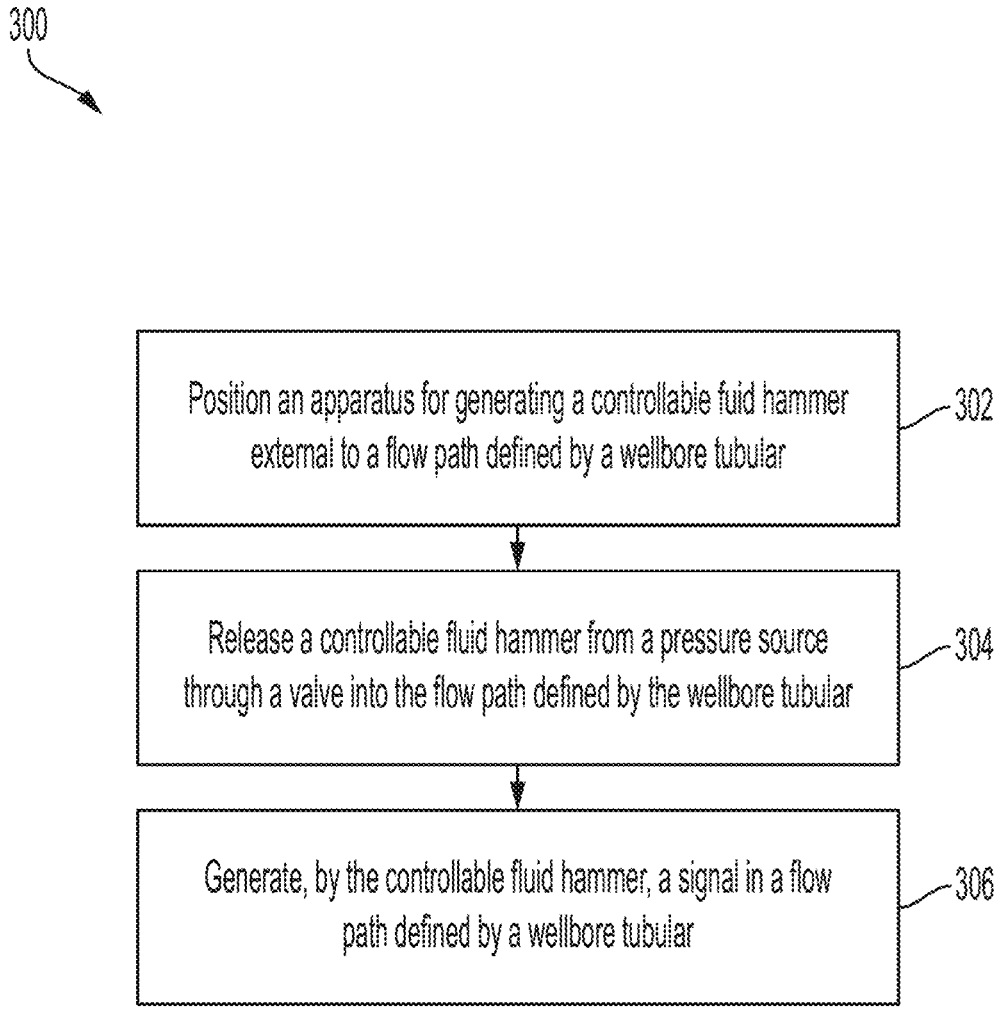
FIG. 3 is a flowchart of a process for deploying an apparatus to generate a pressure wave to detect an anomaly within a flowline or wellbore according to one example of the present disclosure.

FIG. 3 is a flowchart of a process for deploying an apparatus to generate a pressure wave to detect an anomaly within a flowline or wellbore according to one example of the present disclosure. At block 302 the apparatus can be positioned external to a flow path defined by a tubular 104. For example, the flow path of the wellbore tubular may align with a first axis that is a central axis of the tubular 104 disposed in the wellbore 106 and the apparatus may be positioned along a second axis that is different than the first axis. The apparatus can include an attachment port that can be varied for providing a seal between the connection point of the flowline and the port of the apparatus. For example, the attachment port can allow the apparatus to be coupled to a 6-inch (15.24 cm), 12-inch (30.48 cm), or 24-inch (60.96 cm) valve along a flowline or tubular 104 in a wellbore 106. The apparatus can include components as described above and can be used for generating a pressure signal within a flowline or wellbore. The apparatus can be communicatively coupled to a computing device 400 that can be used to execute a simulation of the pressure signal generated within the flowline or wellbore. Based on the simulation, the apparatus can be pressurized, via the pressure source 200, to a predetermined pressure to provide a pressure signal. In some examples, the apparatus can include more than one valve. For example, a first valve can be positioned between the pressure source 200 and the charging cartridge 202 that can be manipulated to pressurize the charging cartridge 202. A second valve may be positioned between the charging cartridge 202 and the controller 204. The second valve may be controlled via the controller 204 that is communicatively coupled to the computing device 400 for releasing the fluid hammer from the apparatus and into the main flow path defined by the tubular 104.

At block 304 the apparatus can release a fluid hammer from a pressure source 200 through a valve in the flow path defined by a tubular 104 disposed in a wellbore 106. For example, the instructions 408 may be executed by the processor 402 to cause the computing device 400 to output a command 410 to the valve 428 to output a fluid hammer into the flow path defined by the wellbore tubular. In some examples, the valve may be opened and closed to produce more than one fluid hammer within the flow path defined by the tubular 104. In some examples, the valve can be opened instantaneously to generate a first fluid hammer. The valve can then be closed by a command from the computing device. The valve can then be opened to generate a second fluid hammer within the flow path defined by the wellbore tubular where the fluid hammer has different properties (e.g., timing, wavelength, amplitude, etc.) to collect multiple pressure signals within the wellbore or flowline.

At block 306 the fluid hammer released by the apparatus 108 can generate a signal in a flow path defined by the tubular 104. The signal that may be generated by the fluid hammer may be a pressure signal that can include properties defined by the pressure released by the apparatus. The signal can be used to detect one of a deposition, a blockage, a leak, or any combination thereof. For example, the signal can travel along the flowline or wellbore. As the signal interacts with physical properties of the flowline such as a bend, T junction, or one or more the blockage, deposition, or leak, a reflection signal may be generated. The reflection signal may travel in the opposite direction to the pressure signal generated by the fluid hammer. The reflection signal can be detected by the sensor and recorded by the data logger, or in some examples, directly transmitted to the computing device 400. The operation of determining the at least one of the blockage of the flow path, the deposition in the flow path, or the leak in the flow path can include generating a pressure signal having a shape and being associated with a opening speed. The sensor may be used to determine a first change to an amplitude of the reflection signal and a second change to the amplitude of the reflection signal subsequent to the first change. The computing device 400 can be used to perform operations and determine one of a blockage, a leak, or a deposition based on the change of a first amplitude of a reflection signal and a second amplitude of a reflection signal subsequent to the first reflection signal.

Figure 4:
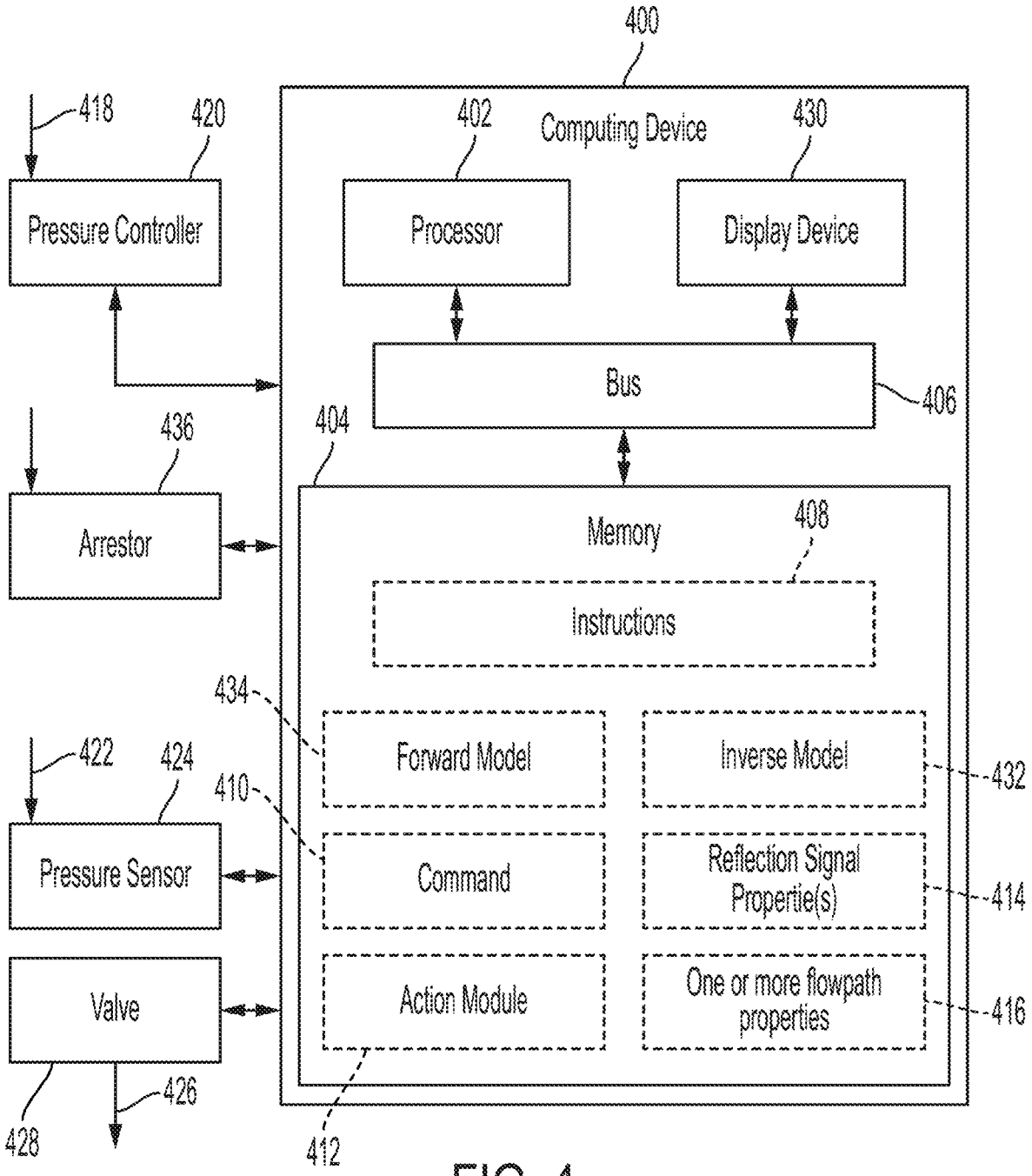
FIG. 4 is a block diagram of a computing device for detecting an anomaly in the flow path within a flowline or wellbore using data detected from a pressure wave, according to one example of the present disclosure.

FIG. 4 is a block diagram of a computing device for detecting an anomly in the flow path within a flowline or wellbore using data detected from a pressure wave, according to one example of the present disclosure. The apparatus can include a computing device 400 having a processor 402, a bus 406, a memory 404, and a display device 430. The computing device 400 can be communicatively coupled to the controller 204. In some examples, the components can be within a single housing with a single processing device. In other examples, the components shown in FIG. 4 can be distributed (e.g., in separate housings) and in electrical communication with each other using various processors. It is also possible for the components to be distributed in a cloud computing system or grid computing system.

The processor 402 can execute one or more operations for determining an operating window. The processor 402 can execute instructions stored in the memory 404 to perform the operations. The processor 402 can include one processing device or multiple processing devices. Non-limiting examples of the processor 402 include field-programmable gate array ("FPGA"), an application-specific integrated circuit ("ASIC"), a processor, a microprocessor, etc.

The processor is communicatively coupled to the memory 404 via the bus 406. The memory 404 may include any type of memory device that retains stored information when powered off. Non-limiting examples of the memory 404 include electrically erasable and programmable read-only memory ("EEPROM"), flash memory, or any other type of non-volatile memory. In some examples, at least some of the memory 404 can include a non-transitory computer-readable medium from which the processor 402 can read instructions. A computer-readable medium can include electronic, optical, magnetic, or other storage devices capable of providing the processor 402 with computer-readable instructions or other program code. Non-limiting examples of a computer-readable medium include (but are not limited to) magnetic disk(s), memory chip(s), read-only memory (ROM), random-access memory ("RAM"), an ASIC, a configured processing device, optical storage, or any other medium from which a computer processing device can read instructions. The instructions can include processing device-specific instructions generated by a compiler or an interpreter from code written in any suitable computer-programming language, including, for example, C, C++, C #, etc.

In some examples, the computing device 400 includes a display device 430. The display device 430 can represent one or more components used to output data. Examples of the display device 430 can include a liquid-crystal display (LCD), a computer monitor, a touch-screen display, etc.

To determine, based on the reflection signal, at least one of a blockage of the flow path, a deposition in the flow path, or a leak in the flow path, the computing device 400 may be used to run a simulation scenario within the boundaries of the flowline to be tested. The computing device 400 can generate a simulation based on properties of the flowline and properties of the fluid present in the flowline. For example, the one or more flowpath properties 416 can include physical properties of the flowline, fluid properties, and properties of transport materials. Examples of the physical properties of the flowline can include a total length and segment length, an average segment length between welds or joins, an inner diameter and an outer diameter of the flowline, a construction material, friction factors and elasticity, a diameter of the wellbore at connection points along the flowline, an attachment port size of the apparatus 108 and an elevation profile. Each of these properties can be determined for a respective span of the flowline that down the wellbore. The physical properties of the flowline may additionally include physical environment properties (e.g., above ground, below ground, or subsea), joining mechanism(s) and positions, and known obstructions or depositions. Examples of the fluid properties can include temperature, viscosity, density, compressibility, anticipated flow regime, and chemical assay results. Each of the fluid properties may be evaluated along the same paths as the physical properties of the flowline. Examples of the properties of transport materials and treatment models can include friction factors and treatments, inhibitor treatments, and acids. Similarly, these properties may be evaluated along the same paths as the physical properties of the flowline.

The computing device 400 can include or be based on the equations above. For example, the computing device 400, using Eqn. 3 can generate an expected reflection signal based on a generated of a water hammer. A water hammer is a pressure surge that results from a fluid being forced to stop or change direction. For example, the pipe length, valve closing time, and volumetric flow through the pipe can be input into Eqn. 3 to determine a target fluid hammer effect, which corresponds to the reflection signal.

The computing device 400 can then control the pressure inflow 418 via a pressure controller 420 for generating a targeted fluid hammer effect within the wellbore or flowline. For example, the computing device 400 can determine a pressure for generating a fluid hammer for sensing a reflection signal within the flowline while the pressure that may be generated may not cause damage to the flowline or wellbore. The pressure controller 420 can include valves and other components. The pressure controller 420 can receive the command 410 from the computing device 400 and control the pressure build-up within the apparatus. For example, the apparatus 108 can include a charging cartridge 202 positioned between the pressure source 200 and the valve for being pressurized by the pressure source at a level of pressure that is higher then the pressure in the wellbore tubular. The computing device can charge the apparatus to a pre-determined, based on the simulations using Eqn. 1-3, pressure for generating the fluid hammer. The computing device 400 can output a command to the valve 428 that can include the opening and closing speed of the valve.

The computing device 400 can, for example, control the valve opening timing 426 for the expected fluid hammer outflow from the apparatus 108 and down into the flowline or wellbore. Alternatively, the valve can be manually opened for generating a fluid hammer within the wellbore or flowline. In some examples, the valve opening timing 426 can be instantaneous, or over a selected time from such that the time spans from a $T_1$ to a predetermined $T_2$ where $T_2$ succeeds $T_1$. For example, the computing device 400 may output a command 410 to the valve 428 to open over a time frame from picoseconds to seconds. The computing device 400 can receiving the reflection signal corresponding to the pressure signal 422 from the sensor 424 to ensure the pressure signal 422 can traverse physical changes, fluid, or composition changes due to flow line intersections, and changes in flowline or wellbore regime due to flow lines or other pipeline properties. The sensor 424 can indicate reflection signal properties 414 (e.g., timing, amplitude, frequency, wavelength etc.) of the reflection signal to the computing device 400. In some examples, the instructions 408 may be executed by the processor 402 to cause the computing device 400 to output a command to the valve 428 to output a second fluid hammer with an adjusted amplitude and an adjusted frequency as compared to a first fluid hammer, into the flow path defined by the tubular 104.

In some examples, the computing device 400 may output a command for generating an expected pressure wave that may include a characteristic to generate a pressure wave that may include a larger amplitude than the pressure wave that may be used to determine a leak, a deposition, or a blockage. To apply a correction to the pressure wave, the computing device 400 may include computational models such as a forward model 434 and an inverse model 432. The sensor may detect a signal from the pressure wave that may include the turbulence of the pressure wave. The sensor may then relay that information to the computing device 400, which can use the models 432, 434 to determine a correction. The computing device 400 may output a command to an arrestor 436 for applying the correction to the desired pressure wave.

Figure 5:
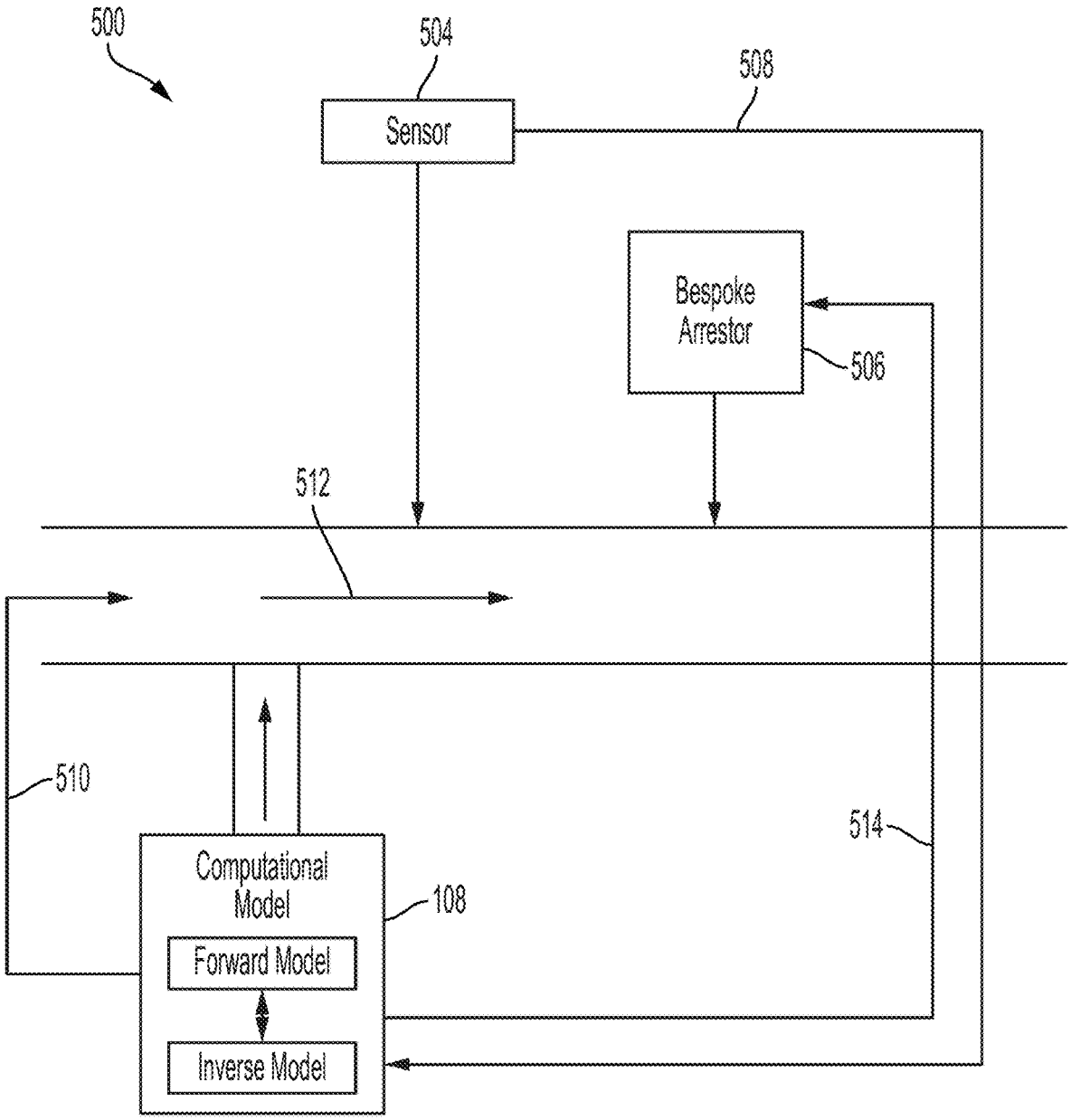
FIG. 5 is a flow diagram of a wellbore and that includes an arrestor for generating a controlled pressure wave into a flow path defined by a wellbore tubular according to one example of the present disclosure.

A fluid hammer, according to various examples, can be controlled in a variety of ways. FIG. 5 depicts an example of a flow diagram for controlling a fluid hammer according to an example of the present disclosure. FIG. 5 further depicts the apparatus 108 of FIG. 2 that includes an arrestor 506 for generating a controlled pressure wave into a flow path defined by a wellbore tubular according to one example of the present disclosure. The apparatus 108 may be positioned to the flow path 512. The apparatus 108 may include a computing device 400 that may include a computational model. The computational model may include a forward model and an inverse model. The apparatus 108 may, using the forward model during the simulation, determine a set of parameters to manipulate the valve to generate the controlled pressure wave. For example, the parameters may include the valve opening speed, the valve closing speed, or a combination thereof. The computing device 400 may then output a command 510 via the computing device 400 to the valve for generating the pressure wave. The output command 510 may include a valve closing speed, a valve opening speed, a valve aperture fraction or a combination thereof. In some examples, the valve that may be manipulated by the apparatus 108 is a continuous solenoid valve. The pressure wave may traverse the flow path 512. The pressure wave may have a higher amplitude than the calculated pressure wave. The higher amplitude pressure wave turbulence may be sensed by the sensor 504.

The computing device 400 can include or be based on the equations above. For example, the computing device 400 may first receive the sensing information 508 from the sensor 504 (e.g., the turbulence from the valve opening due to the apparatus), and then, the computing device may output a command 514 to the arrestor 506 for applying a correction to the pressure wave within the flowline. In some examples, the correction applied may be based on the inverse model of the computing device 400 that may be within the apparatus 108. In some examples, the sensing information 508 that may be the turbulence of the pressure wave may be detected by the sensor 504. The computing device 400 within the apparatus 108 may perform an operation that may include comparing the estimated Reynolds number for the calculated pressure wave to the sensing information from the generated pressure wave. Subsequent to comparing the estimated pressure wave to the generated pressure wave, the computing device, may output a command 514 to the arrestor 506 that may modify at least one property of the pressure wave to generate a controlled pressure wave in the flowline. For example, the property may be the frequency, the amplitude, or the wavelength of the pressure wave.

In some aspects, a system, and a method for determining an at least one of a blockage of the flow path, a deposition in the flow path, or a leak in the flow path are provided according to one or more of the following examples: As used below, any reference to a series of examples is to be understood as a reference to each of those examples disjunctively (e.g., "Examples 1-4" is to be understood as "Examples 1, 2, 3, or 4").

Example 1 is a system comprising: a pressure source; a valve; and a controller to output a command to control the pressure source for outputting a controllable fluid hammer through the valve and into a flow path defined by a tubular, wherein the system is positionable external to the flow path.

Example 2 is the system of example(s) 1, wherein the flow path aligns with a first axis that is a central axis of the tubular and the system is positionable along a second axis that is different than the first axis.

Example 3 is the system of example(s) 1, further comprising a charging cartridge positioned between the pressure source and the valve for being pressurized by the pressure source at a level of pressure that is higher than the pressure in the tubular.

Example 4 is the system of example(s) 1, further comprising a sensor to sense data indicating one or more properties of a reflection signal corresponding to a pressure signal, wherein the reflection signal and pressure signal are generated from the controllable fluid hammer in the flow path.

Example 5 is the system of example(s) 4, further comprising: a data logger for collecting the one or more properties of a reflection signal; and a computing device communicatively couplable to the controller to generate the controllable fluid hammer within the flow path defined by the tubular, wherein the computing device comprises: a processor; and a non-transitory computer-readable medium comprising instructions that are executable by the processor for causing the processor to perform operations comprising: receiving the reflection signal corresponding to the pressure signal from the sensor; determining, based on the reflection signal, at least one of a blockage of the flow path, a deposition in the flow path, or a leak in the flow path; and determining, based on the reflection signal, a position of the blockage, the deposition, or the leak.

Example 6 is the system of example(s) 5, wherein the operation of determining the at least one of the blockage of the flow path, the deposition in the flow path, or the leak in the flow path comprises: generating the pressure signal having a shape and being associated with a opening speed; receiving the signal corresponding to the pressure signal from the sensor; determining, based on the signal corresponding to a pressure signal, a correction, using the arrestor, to adjust the pressure signal; determining a first change to an amplitude of the reflection signal; and determining a second change to the amplitude of the reflection signal subsequent to the first change.

Example 7 is the system of example(s) 5, wherein the instructions are executable by the processor to cause the computing device to output a command to the valve to output a second controllable fluid hammer with an adjusted amplitude and an adjusted frequency as compared to a first controllable fluid hammer, into the flow path defined by the tubular.

Example 8 is a method comprising: positioning an apparatus for generating a controllable fluid hammer via a pressure source external to a flow path defined by a tubular; releasing the controllable fluid hammer from the pressure source through a valve into the flow path defined by the tubular; and generating, by the controllable fluid hammer, a signal in a flow path defined by a tubular.

Example 9 is the method of example(s) 8, wherein the flow path aligns with a first axis that is a central axis of the tubular and the apparatus for generating a controllable fluid hammer is positionable along a second axis that is different than the first axis.

Example 10 is the method of example(s) 8, further comprising positioning a charging cartridge between the pressure source and the valve for being pressurized by the pressure source at a level of pressure that is higher than the pressure in the tubular.

Example 11 is the method of example(s) 8, further comprising positioning a sensor to sense data indicating one or more properties of a reflection signal corresponding to a pressure signal, wherein the reflection signal and pressure signal are generated from the controllable fluid hammer in the flow path.

Example 12 is the method of example(s) 11, further comprising: collecting the one or more properties of a reflection signal using a data logger communicatively coupled to the sensor; and generating the controllable fluid hammer, via a computing device communicatively couplable to a controller, within the flow path defined by the tubular; receiving the reflection signal corresponding to the pressure signal from the sensor; determining, based on the reflection signal, at least one of a blockage of the flow path, a deposition in the flow path, or a leak in the flow path; and determining, based on the reflection signal, a position of the blockage, the deposition, or the leak.

Example 13 is the method of example(s) 12, wherein determining the at least one of the blockage of the flow path, the deposition in the flow path, or the leak in the flow path comprises: generating the pressure signal having a shape and being associated with a closing speed; receiving the signal corresponding to the pressure signal from the sensor; determining, based on the signal corresponding to a pressure signal, a correction, using the arrestor, to adjust the pressure signal; determining a first change to an amplitude of the reflection signal; and determining a second change to the amplitude of the reflection signal subsequent to the first change.

Example 14 is the method of example(s) 12, further comprising: outputting a command to the valve to output a second controllable fluid hammer with an adjusted amplitude and an adjusted frequency as compared to a first controllable fluid hammer, into the flow path defined by the tubular.

Example 15 is a system comprising: a tubular defining a flow path; an apparatus positionable external to the flow path, the apparatus comprising: a pressure source; a valve; and a controller to output a command to control the pressure source for outputting a controllable fluid hammer through the valve and into the flow path.

Example 16 is the system of example(s) 15, wherein the flow path aligns with a first axis that is a central axis of the tubular and the system is positionable along a second axis that is different than the first axis.

Example 17 is the system of example(s) 15, further comprising a charging cartridge positioned between the pressure source and the valve for being pressurized by the pressure source at a level of pressure that is higher then the pressure in the tubular.

Example 18 is the system of example(s) 15, further comprising a sensor to sense data indicating one or more properties of a reflection signal corresponding to a pressure signal, wherein the reflection signal and pressure signal are generated from the controllable fluid hammer in the flow path.

Example 19 is the system of example(s) 18, further comprising: a data logger for collecting the one or more properties of a reflection signal; and a computing device communicatively couplable to the controller to generate the controllable fluid hammer within the flow path defined by the tubular, wherein the computing device comprises: a processor; and a non-transitory computer-readable medium comprising instructions that are executable by the processor for causing the processor to perform operations comprising: receiving the reflection signal corresponding to the pressure signal from the sensor; determining, based on the reflection signal, at least one of a blockage of the flow path, a deposition in the flow path, or a leak in the flow path; and determining, based on the reflection signal, a position of the blockage, the deposition, or the leak.

Example 20 is the system of example(s) 19, wherein the operation of determining the at least one of the blockage of the flow path, the deposition in the flow path, or the leak in the flow path comprises: generating the pressure signal having a shape and being associated with a closing speed; receiving the signal corresponding to the pressure signal from the senor; determining, based on the signal corresponding to a pressure signal, a correction, using the arrestor, to adjust the pressure signal; determining a first change to an amplitude of the reflection signal; and determining a second change to the amplitude of the reflection signal subsequent to the first change.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a pressure source;

a valve;

a sensor to sense data indicating one or more properties of a first reflection signal corresponding to a pressure signal, wherein the first reflection signal and the pressure signal are generated from a first controllable fluid hammer in a flow path; and a computing device to output a command to control the pressure source for outputting the first controllable fluid hammer through the valve and into the flow path defined by a tubular, wherein the system is positionable external to the flow path, wherein the computing device comprises:

a processor; and a non-transitory computer-readable medium comprising instructions that are executable by the processor for causing the processor to perform operations comprising:

receiving the first reflection signal corresponding to the pressure signal from the sensor; and determining, based on the reflection signal, at least one of a blockage of the flow path, a deposition in the flow path, or a leak in the flow path using a controlled shape of the pressure signal, wherein the operation of determining the at least one of the blockage of the flow path, the deposition in the flow path, or the leak in the flow path further comprises:

determining, based on the reflection signal corresponding to the pressure signal, a correction, using an arrestor, to adjust the pressure signal;

determining a first change to an amplitude of a second reflection signal; and determining a second change to the amplitude of the second reflection signal subsequent to the first change.

2. The system of claim 1, wherein the flow path aligns with a first axis that is a central axis of the tubular and the system is positionable along a second axis that is different than the first axis.

3. The system of claim 1, further comprising a charging cartridge positioned between the pressure source and the valve for being pressurized by the pressure source at a level of pressure that is higher than the pressure in the tubular.

4. The system of claim 1, further comprising:

a data logger for collecting the one or more properties of the first or second reflection signal;

wherein the non-transitory computer-readable medium further comprises the instructions that are executable by the processor for causing the processor to perform operations comprising:

determining, based on the first reflection signal or the second reflection signal, a position of the blockage, the deposition, or the leak.

5. The system of claim 4, wherein the instructions are executable by the processor to cause the computing device to output a command to the valve to output a second controllable fluid hammer with an adjusted amplitude and an adjusted frequency as compared to the first controllable fluid hammer, into the flow path defined by the tubular.

6. A method comprising:

controlling, by a computing device, a positioning of an apparatus for generating a first controllable fluid hammer via a pressure source external to a flow path defined by a tubular;

controlling, by the computing device, positioning of a sensor to sense data indicating one or more properties of a first reflection signal corresponding to a pressure signal, wherein the first reflection signal and pressure signal are generated from the first controllable fluid hammer in the flow path;

controlling, by the computing device, generation of the first controllable fluid hammer within the flow path defined by the tubular;

controlling, by the computing device, release of the first controllable fluid hammer from the pressure source through a valve into the flow path defined by the tubular;

receiving, by the computing device, the first reflection signal corresponding to the pressure signal from the sensor; and determining, by the computing device and based on the reflection signal, at least one of a blockage of the flow path, a deposition in the flow path, or a leak in the flow path using a controlled shape of the pressure signal, wherein determining the at least one of the blockage of the flow path, the deposition in the flow path, or the leak in the flow path further comprises:

determining, based on the reflection signal corresponding to the pressure signal, a correction, using an arrestor, to adjust the pressure signal;

determining a first change to an amplitude of a second reflection signal; and determining a second change to the amplitude of the second reflection signal subsequent to the first change.

7. The method of claim 6, wherein the flow path aligns with a first axis that is a central axis of the tubular and the apparatus for generating the controllable fluid hammer is positionable along a second axis that is different than the first axis.

8. The method of claim 6, further comprising positioning a charging cartridge between the pressure source and the valve for being pressurized by the pressure source at a level of pressure that is higher than the pressure in the tubular.

9. The method of claim 6, further comprising:

collecting the one or more properties of the first reflection signal or the second reflection signal using a data logger communicatively coupled to the sensor; and determining, by the computing device and based on the first reflection signal or the second reflection signal, a position of the blockage, the deposition, or the leak.

10. The method of claim 9, further comprising:

outputting a command to the valve to output a second controllable fluid hammer with an adjusted amplitude and an adjusted frequency as compared to the first controllable fluid hammer, into the flow path defined by the tubular.

11. A system comprising:

a tubular defining a flow path; and an apparatus positionable external to the flow path, the apparatus comprising:

a pressure source;

a valve;

a sensor to sense data indicating one or more properties of a first reflection signal corresponding to a pressure signal, wherein the first reflection signal and pressure signal are generated from a first controllable fluid hammer in the flow path; and a computing device to output a command to control the pressure source for outputting the first controllable fluid hammer through the valve and into the flow path, wherein the computing device comprises:

a processor; and a non-transitory computer-readable medium comprising instructions that are executable by the processor for causing the processor to perform operations comprising:

receiving the first reflection signal corresponding to the pressure signal from the sensor; and determining, based on the reflection signal, at least one of a blockage of the flow path, a deposition in the flow path, or a leak in the flow path using a controlled shape of the pressure signal, wherein the operation of determining the at least one of the blockage of the flow path, the deposition in the flow path, or the leak in the flow path further comprises:

determining, based on the reflection signal corresponding to the pressure signal, a correction, using an arrestor, to adjust the pressure signal;

determining a first change to an amplitude of a second reflection signal; and determining a second change to the amplitude of the second reflection signal subsequent to the first change.

12. The system of claim 11, wherein the flow path aligns with a first axis that is a central axis of the tubular and the system is positionable along a second axis that is different than the first axis.

13. The system of claim 11, further comprising a charging cartridge positioned between the pressure source and the valve for being pressurized by the pressure source at a level of pressure that is higher than the pressure in the tubular.

14. The system of claim 11, further comprising:

a data logger for collecting the one or more properties of the first reflection signal or the second reflection signal, wherein the instructions that are executable by the processor for causing the processor to perform operations further comprise:

determining, by the computing device and based on the first or the second reflection signal, a position of the blockage, the deposition, or the leak.

* * * * *